US009327172B2

(12) United States Patent
Deshmukh et al.

(10) Patent No.: US 9,327,172 B2
(45) Date of Patent: May 3, 2016

(54) MID-DENSITY MATERIALS FOR GOLF APPLICATIONS

(71) Applicant: Acushnet Company, Fairhaven, MA (US)

(72) Inventors: Uday V. Deshmukh, Carlsbad, CA (US); Ronald K. Hettinger, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 428 days.

(21) Appl. No.: 13/679,338

(22) Filed: Nov. 16, 2012

(65) Prior Publication Data

US 2014/0141904 A1 May 22, 2014

(51) Int. Cl.
*A63B 53/04* (2015.01)

(52) U.S. Cl.
CPC ..... *A63B 53/0466* (2013.01); *A63B 53/047* (2013.01); *A63B 53/0487* (2013.01); *A63B 2053/0437* (2013.01); *A63B 2053/0491* (2013.01); *A63B 2209/00* (2013.01)

(58) Field of Classification Search
USPC ..... 473/324–350
See application file for complete search history.

(56) References Cited

U.S. PATENT DOCUMENTS 6,334,817 B1 * 1/2002 Ezawa et al. ..... 473/324
6,447,715 B1 9/2002 Amick
6,491,592 B2 * 12/2002 Cackett et al. ..... 473/342
6,533,681 B2 * 3/2003 Inoue et al. ..... 473/342
6,666,779 B1 * 12/2003 Iwata et al. ..... 473/350
6,878,074 B2 * 4/2005 Byrne et al. ..... 473/349
6,945,307 B2 * 9/2005 Tsai ..... 164/76.1
7,086,960 B2 * 8/2006 Huang et al. ..... 473/305
7,108,614 B2 * 9/2006 Lo ..... 473/345
7,175,541 B2 * 2/2007 Lo ..... 473/345
7,217,389 B2 5/2007 Amick
7,429,219 B2 * 9/2008 Huang ..... 473/349
7,448,961 B2 * 11/2008 Lin ..... 473/332
7,494,425 B2 2/2009 DeShiell et al.
7,722,805 B2 * 5/2010 Hao et al. ..... 420/417
7,744,486 B2 * 6/2010 Hou et al. ..... 473/329
7,749,096 B2 7/2010 Gibbs et al.
7,922,604 B2 4/2011 Roach et al.
8,221,261 B2 7/2012 Curtis et al.

(Continued)

FOREIGN PATENT DOCUMENTS

EP 1175923 A1 * 1/2002 ..... A63B 53/04

*Primary Examiner* — John E Simms, Jr.
(74) *Attorney, Agent, or Firm* — Adler Pollock & Sheehan P.C.; Daniel J. Holmander, Esq.; George N. Chaclas, Esq.

(57) ABSTRACT

The golf club head has a body comprising a crown portion, a sole portion, a toe portion, heel portion, hosel portion, rear portion, and a front portion including a striking face. At least one or more portions of the body of the golf club head is made out of at least one or more mid-density materials. The at least one mid-density material or composite of mid-density materials have a density within a range from about 4.5 g/cm$^3$ to 7.9 g/cm$^3$. The mid-density material or composite of mid-density materials provide sufficient stiffness at a reduced weight to optimize the center of gravity and moment of inertia of the golf club head. Also, by using mid-density materials, discretionary weight of the golf club head is increased which can be used to position higher density weights at selective portions of the golf club head.

15 Claims, 4 Drawing Sheets

(56) References Cited

U.S. PATENT DOCUMENTS 8,342,985 B2 * 1/2013 Hirano ..... 473/350
8,348,785 B2 * 1/2013 Chen et al. ..... 473/342
8,858,363 B2 * 10/2014 Wada et al. ..... 473/346
8,876,632 B2 * 11/2014 Deshmukh et al. ..... 473/342
2007/0209738 A1 * 9/2007 Liu et al. ..... 148/329

* cited by examiner

| | CG Results | | | | | | | | MOI Results | | | |
|---|---|---|---|---|---|---|---|---|---|---|---|---|
| | CG-A-sa (mm) | CG-B-sa (mm) | CG-C-sa (mm) | CG-x-fc (mm) | CG-y-fc (mm) | CG-z-fc (mm) | CG-y-g (mm) | CG-NA (mm) | MOI-x (kg*mm^2) | MOI-y (kg*mm^2) | MOI-z (kg*mm^2) | MOI-Shaft (kg*mm^2) |
| Regular | -67.7 | 28.4 | -12.7 | 1.8 | -2.5 | -24.8 | 16.4 | 4.2 | 128.7 | 301.5 | 231.0 | 442.6 |
| Mid-density | -68.2 | 27.7 | -11.4 | 2.1 | 2.1 | -23.5 | 15.6 | 3.1 | 109.7 | 299.3 | 242.8 | 422.8 |
| | | | CG forward for more ball speed | | | | Lower CG, closer to neutral axis | | | Maintain high MOI | | |

Fig. 4

MID-DENSITY MATERIALS FOR GOLF APPLICATIONS

BACKGROUND

The present invention relates generally to golf applications, and more particularly to a golf club. More specifically, a golf club head of the golf club has at least one or more portions including at least one mid-density material having a density ranging from 4.5 g/cm$^3$ to 7.9 g/cm$^3$ which provide sufficient stiffness at a reduced weight to optimize the center of gravity and moment of inertia of the golf club head. Also, by using mid-density materials, discretionary weight of the golf club head is increased which can be used to position higher density weights at selective portions of the golf club head.

Materials used in the construction of golf clubs have varying densities. This range includes from 1.8 g/cm$^3$ for carbon fiber composites to tungsten based materials having density of 18.5 g/cm$^3$. However the most common materials used are metallic materials such as steels and titanium alloys having a density of about 7.9 g/cm$^3$ and 4.5 g/cm$^3$ respectively.

Most golf clubs are made from steel or titanium alloys, and over the many decades of golf club manufacture other materials have been used such as brass, copper, bronze, aluminum, plastics, fiberglass, composites, and, of, course, wood. These materials generally have densities either at or lower than titanium, or at or above steel.

With the exception of carbon fiber composites, materials lighter than titanium typically have fairly low stiffness, and are therefore generally unsuitable for use in most types of golf clubs because their low inherent stiffness generate low frequency vibrations when impacting a golf ball. Low frequency vibrations are considered "bad feel" and "bad sound" for a golf club. Materials heavier than steel usually have good stiffness, but are generally too heavy to be used for anything but discretionary weights in golf.

Therefore, it would be advantageous in golf club design to provide a golf club head having at least one or more portions made of mid-density materials having a density ranging from 4.5 g/cm$^3$ to 7.9 g/cm$^3$, between titanium and steel, which provide sufficient stiffness at a reduced weight to optimize the center of gravity and moment of inertia of the golf club head.

BRIEF SUMMARY OF THE INVENTION

The present invention relates generally to golf applications, and more particularly to a golf club. More specifically, a golf club head of the golf club has at least one or more portions including at least one mid-density material having a density ranging from 4.5 g/cm$^3$ to 7.9 g/cm$^3$ which provide sufficient stiffness at a reduced weight to optimize the center of gravity and moment of inertia of the golf club head. Also, by using mid-density materials, discretionary weight of the golf club head is increased which can be used to position higher density weights at selective portions of the golf club head.

Of course, it is also contemplated that other areas of the golf club, such as the shaft or hosel, or other golf applications may use at least one or more of the mid-density materials having a density ranging from 4.5 g/cm$^3$ to 7.9 g/cm$^3$.

The golf club head includes a body comprising a crown portion, a sole portion, a toe portion, heel portion, rear portion, and a front portion including a striking face. In one embodiment, the body is made out of at least one or more mid-density materials. The at least one mid-density material or composite of mid-density materials have a density within a range from 4.5 g/cm$^3$ to 7.9 g/cm$^3$. The mid-density material or composite of mid-density materials provide sufficient stiffness at a reduced weight to optimize the center of gravity and moment of inertia of the golf club head during operation.

At least a portion of the golf club head is made of mid-density materials having a density ranging from 4.5 g/cm$^3$ to 7.9 g/cm$^3$. For example, at least a portion of the golf club head is made of mid-density materials having a density ranging from 5 g/cm$^3$ to 7.9 g/cm$^3$, and more preferably between approximately 5.5 g/cm$^3$ to 7.5 g/cm$^3$, and even more preferably 6 g/cm$^3$ to 7 g/cm$^3$.

In one embodiment, the mid-density materials have an alloy selected from the group consisting of: Fe—Cr—Al, Fe—Cr—Si, Fe—Cr—B, Fe—Cr—C, Fe—Mn—Al, Fe—Mn—Si, Fe—Mn—B, Fe—Mn—C, Fe—V—Al, Fe—V—Si, Fe—V—B, Fe—V—C, Fe—Ti—Al, Fe—Ti—Si, Fe—Ti—B, Fe—Ti—C, Fe—Zr—Al, Fe—Zr—Si, Fe—Zr—B, and Fe—Zr—C. In another embodiment, the mid-density materials have an alloy selected from the group consisting of: Ti—Zr, Ti—Hf, Ti—V, Ti—Cr, Ti—Mo, Ti—Nb, Ti—W, Ti—Ta, and ternary Ti—W—Ta. For example, the Ti-32 wt % W has a density of about 6 g/cm$^3$, Ti-40 wt % W has a density of about 6.5 g/cm$^3$, and Ti-46 wt % W has a density of about 7 g/cm$^3$.

In another embodiment, the mid-density materials are co-forged titanium and steel. Also, co-forged steel and titanium may be combined with a third element. The third element is a selected from a group consisting of: nickel, copper, metallic metals, and ceramic powder compacts. For example, the steel may be in the form of a steel structure and the titanium is in the form of one or more metal rods which are collected within the steel structure and then co-forged. Alternatively, the titanium may be in the form of a titanium structure and the steel in the form of one or more metal rods which are collected within the titanium structure and then co-forged.

In another embodiment, the mid-density materials may have an alloy selected from the group consisting of: Zr—Nb, Zr—Mo, Zr—Hf, Zr—Ta, Zr—W, and Zr—Re. The densities of the one or more these mid-density materials may range from 6 g/cm$^3$ to 7.25 g/cm$^3$. For example, the mid-density material includes Ti—Zr having a density ranging from 4.5 g/cm$^3$ to 6.4 g/cm$^3$ and Ti—Zr—Hf having a density higher than 6.5 g/cm$^3$. The mid-density materials may have two or more elements selected from the group consisting of: Ti, Zr, and Hf to provide a density range from 4.5 g/cm$^3$ to 7.9 g/cm$^3$.

In another embodiment, the mid-density materials are Fe—Al alloys having reduced grain size. The Fe—Al alloys having reduced grain size include one or more elements selected from the group consisting of: Ti and Zr.

There are many methods for forming a golf club head using mid-density materials. The golf club head is formed by introducing at least one or more mid-density materials therein. The mid-density material has a density ranging from 4.5 g/cm$^3$ to 7.9 g/cm$^3$.

In one embodiment, the mid-density materials are provided by decreasing the density of an iron-based material. For example, one or more primary elements are added to the iron-based material. The one or more primary elements are selected from a group consisting of: titanium, vanadium, chromium, manganese, and zirconium. The primary elements have a lower density than iron-based materials and thereby decrease the density of the iron-based material. In addition, one or more secondary elements are added to the one or more primary elements. The secondary elements are selected from a group consisting of: aluminum, silicon, carbon, and boron.

In one embodiment, at least one primary element and the iron-based material or primary element and secondary element combined with the iron based material may be co-forged to provide the mid-density material. The method for co-forging comprising casting the mid-density materials into a preform, homogenizing the preform, annealing the preform, and forging the preform into a golf club head shape with differing cross-sections.

In another embodiment, the mid-density materials are provided by increasing the density of a titanium alloy material. For example, one or more metallic elements are added to the titanium alloy material. The one or more metallic elements selected from a group consisting of: tungsten, tantalum, hafnium, molybdenum, niobium, vanadium, chromium, and zirconium. The metallic elements have a higher density than titanium alloy materials and thereby increase the density of the titanium alloy materials.

In one embodiment, at least one metallic element and the titanium alloy material may be combined to provide the mid-density material. For example, the at least one metallic element and the titanium alloy material are melted and then cast into a golf club head shape made of mid-density material.

In another embodiment, one or more compositions are co-forged to provide the mid-density material. For example, titanium and steel may be co-forged when heated to a temperature of 1000 degrees Celsius.

In a further embodiment, another method for manufacturing a golf article using mid-density materials is provided. One or more rods are provided which are made of one or more compositions or a composite of one or more compositions. The rods are collected together using a collecting structure made of one or more compositions or a composite of one or more compositions. The one or more rods and collecting structure are heated to a forging temperature to provide a preform. The preform is then forged into a golf article, such as a golf club head. A portion of the golf club head is thereby made of mid-density materials having a density ranging from 4.5 g/cm$^3$ to 7.9 g/cm$^3$. In one embodiment, the one or more compositions are titanium and steel.

Objectives, features and advantages of the embodiments shall become apparent as the description thereof proceeds when considered in connection with the accompanying illustrative drawings.

BRIEF DESCRIPTION OF THE DRAWING FIGURES

In the drawings which illustrate several exemplary modes or embodiments for carrying out the present invention:

FIG. 4 is a table showing the center or gravity and moment of inertia results relative to the use of mid-density vs. regular materials.

DETAILED DESCRIPTION OF A PREFERRED EMBODIMENT

Figure 1:
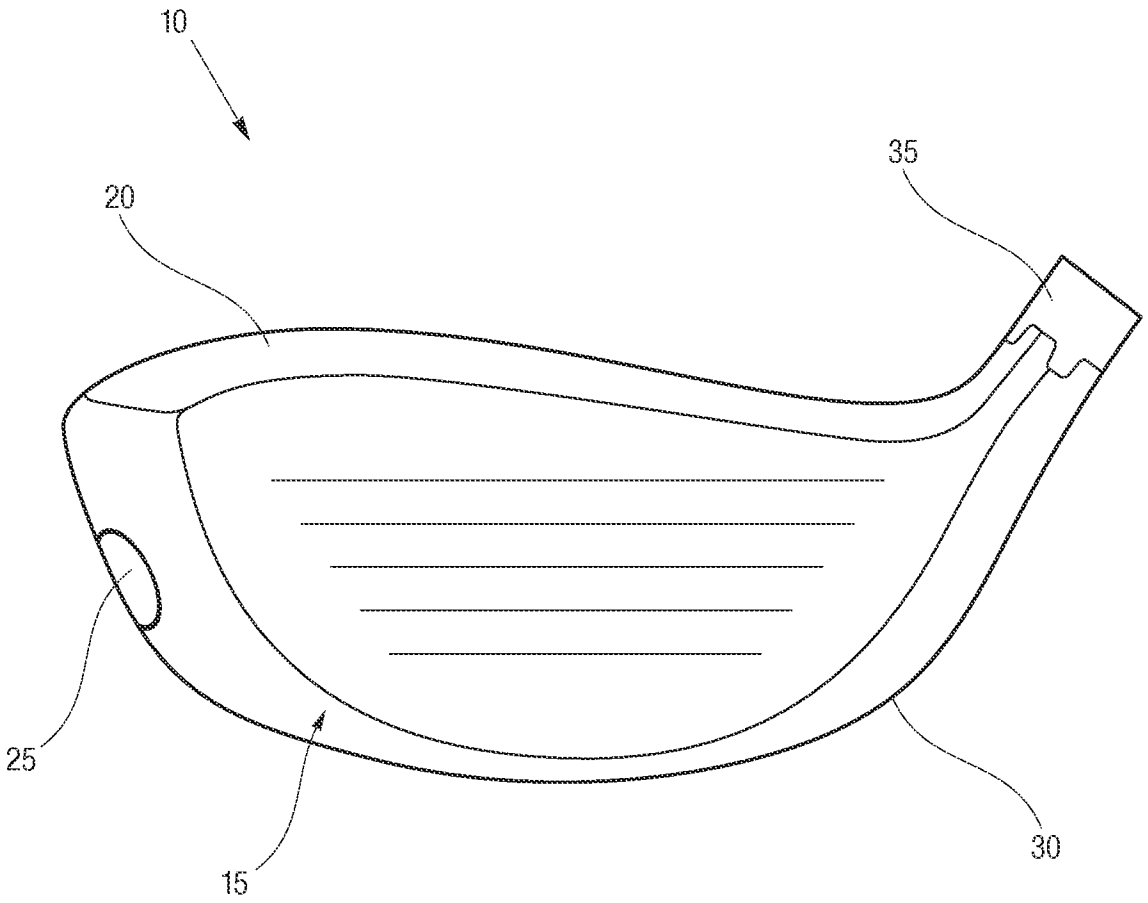
FIG. 1 is a perspective view of an exemplary embodiment of a golf club head using one or more mid-density materials.
Figure 2:
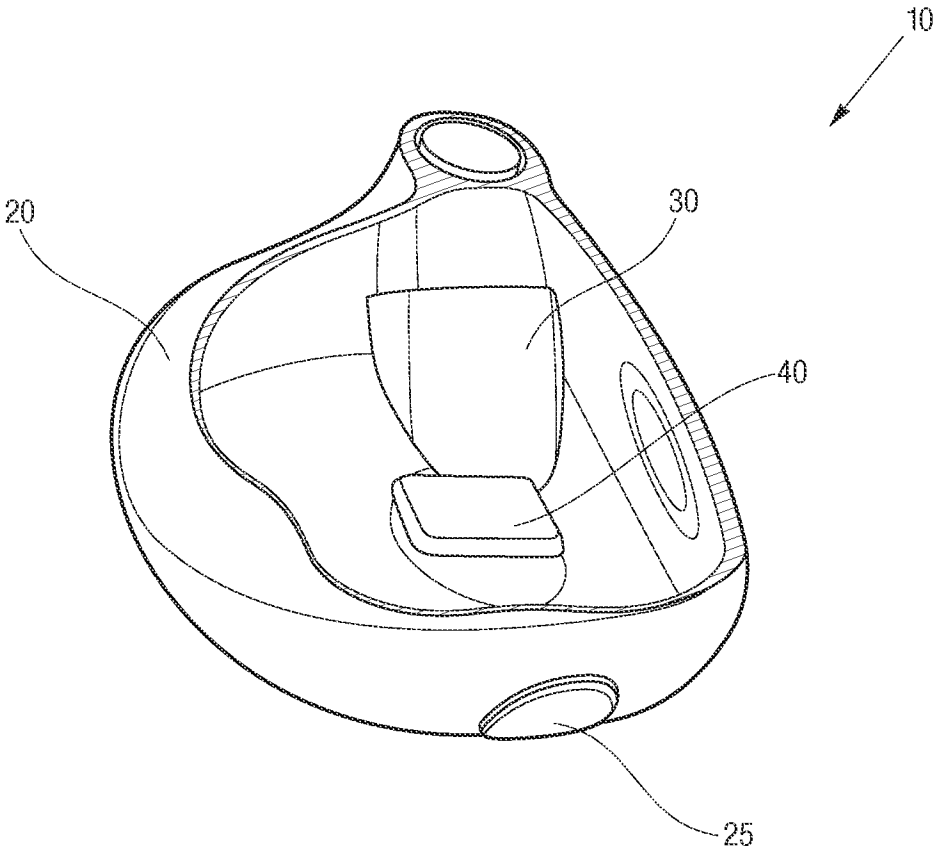
FIG. 2 is a top view of the golf club head of FIG. 1 with the crown portion partially removed to show an interior thereof.
Figure 3:
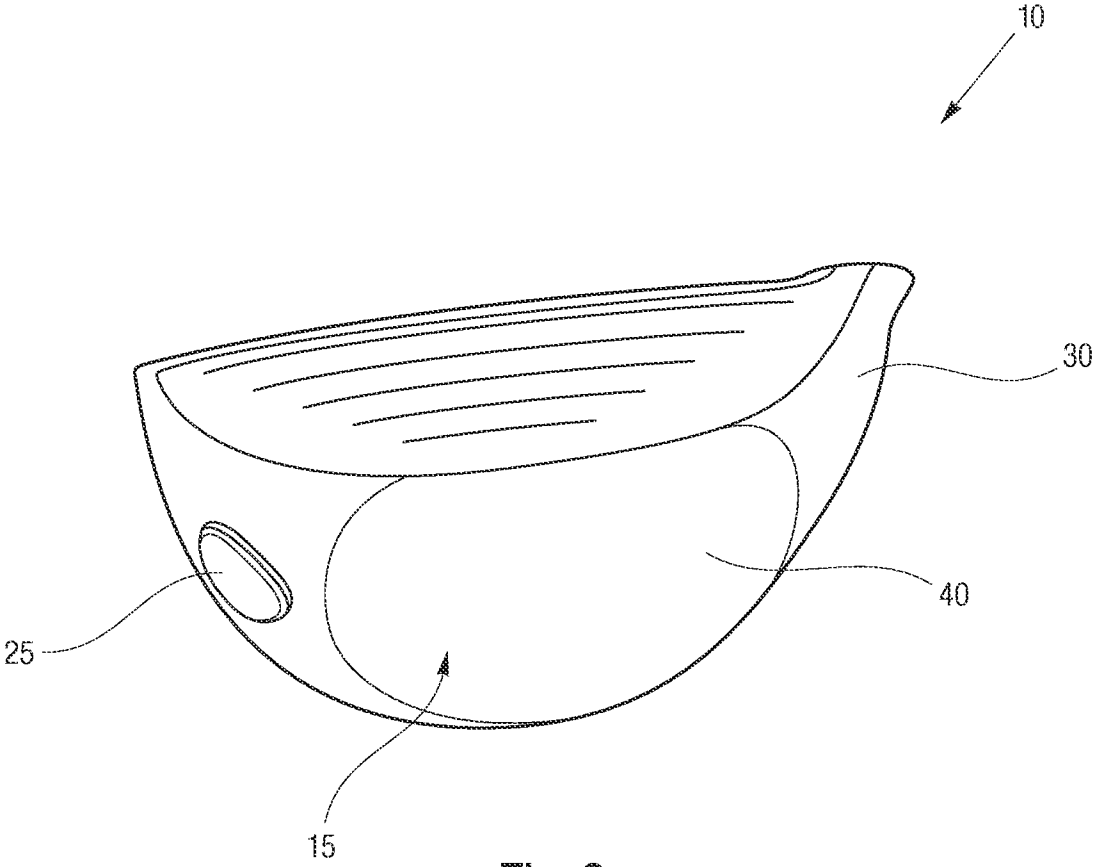
FIG. 3 is a bottom view of the golf club head of FIG. 1.

Referring now to the drawings, an embodiment is illustrated and generally indicated at 10 in FIGS. 1-3. The present invention relates generally to golf applications, and more particularly to a golf club head. More specifically, a golf club head of the golf club has a body with at least one or more portions including at least one mid-density material having a density ranging from 4.5 g/cm$^3$ to 7.9 g/cm$^3$ which provide sufficient stiffness at a reduced weight to optimize the center of gravity and moment of inertia of the golf club head. Also, by using mid-density materials, discretionary weight of the golf club head is increased which can be used to position higher density weights at selective portions of the golf club head.

Of course, it is also contemplated that other areas of the golf club, such as the shaft or hosel, or other golf applications may use at least one or more of the mid-density materials having a density ranging from 4.5 g/cm$^3$ to 7.9 g/cm$^3$. In another embodiment, the mid-density materials may have density ranging from 5 g/cm$^3$ to 7.9 g/cm$^3$, and more preferably between approximately 5.5 g/cm$^3$ to 7.5 g/cm$^3$, and even more preferably 6 g/cm$^3$ to 7 g/cm$^3$. The golf club head includes materials made with traditional processes such as melting and casting as well as materials that are made as metal-metal composites. Mid-density materials can be used for irons, drivers, wedges, hybrids, utility clubs, putters, and fairway woods or in other golf applications.

As will hereafter be more fully described, the embodiment of the golf club head 10 is provided in accordance with the teachings herein. The golf club head 10 includes a body 15 comprising a crown portion 20, a sole portion 40, a toe portion 25, heel portion 30, hosel portion 35, rear portion 45, and a front portion 50 including a striking face 50A. At least a portion of the golf club head 10 is made out of at least one or more mid-density materials. In another embodiment, the entire body of the golf club head is cast using mid-density materials.

For example, referring to FIGS. 1-3 of the golf club head 10, the body 15 is initially formed, using casting or other methods described below, with mid-density materials. A section of the crown portion 20 is made of titanium. Since the body 15 is cast in mid-density materials, higher density weights may be added to the golf club head 10 at selective areas. Toe weight member and heel weight members, ranging approximately from 10 g/cm$^3$ to 17 g/cm$^3$, are added to the toe portion 25 and heel portion 30 respectively. Sole weight member is added to the sole portion 40 of the body 15. Hosel components are added to the hosel portion 35 of the body 15.

Referring to FIG. 4, a table is shown which demonstrates the benefits of using mid-density materials in the exemplary embodiment of FIGS. 1-3 with regards to center of gravity (CG) and moment of inertia (MOI) in comparison to regular materials, such as steel. Of course, this is an exemplary embodiment and other configurations of golf club heads are contemplated using mid-density materials.

The golf club head is made of mid-density materials having a density ranging from 4.5 g/cm$^3$ to 7.9 g/cm$^3$. For example, at least a portion of the golf club head is made of mid-density materials having a density ranging from 5 g/cm$^3$ to 7.9 g/cm$^3$, and more preferably between approximately 5.5 g/cm$^3$ to 7.5 g/cm$^3$, and even more preferably 6 g/cm$^3$ to 7 g/cm$^3$. The mid-density materials may include alloys which shall be described further herein. In one embodiment, the mid-density materials have a an alloy selected from the group consisting of: Fe—Cr—Al, Fe—Cr—Si, Fe—Cr—B, Fe—Cr—C, Fe—Mn—Al, Fe—Mn—Si, Fe—Mn—B, Fe—Mn—C, Fe—V—Al, Fe—V—Si, Fe—V—B, Fe—V—C, Fe—Ti—Al, Fe—Ti—Si, Fe—Ti—B, Fe—Ti—C, Fe—Zr—Al, Fe—Zr—Si, Fe—Zr—B, and Fe—Zr—C.

In another embodiment, the mid-density materials have an alloy selected from the group consisting of: Ti—V, Ti—Zr, Ti—Cr, Ti—Mo, Ti—Nb, Ti—Hf, Ti—W, Ti—Ta, and ternary Ti—W—Ta. For example, the Ti-32 wt % W has a density of about 6 g/cm$^3$, Ti-40 wt % W has a density of about 6.5 g/cm$^3$, and Ti-46 wt % W has a density of about 7 g/cm$^3$.

In another embodiment, the mid-density materials are co-forged titanium and steel. Also, co-forged steel and titanium may be combined with a third element. The third element is selected from a group consisting of: nickel, copper, metallic metals, and ceramic powder compacts. For example, the steel may be in the form of a steel structure and the titanium may be in the form of one or more metal rods which are collected within the steel structure and then co-forged. Alternatively, the titanium may be in the form of a titanium structure and the steel in the form of one or more metal rods which are collected within the titanium structure and then co-forged.

TABLE I

| Density g/cm$^3$ | Nb Niobium | Mo Molybdenum | Hf Hafnium | Ta Tantalum | W Tungsten | Re Rhenium |
|---|---|---|---|---|---|---|
| 6.5 | Zr—6% Nb | Zr—4% Mo | Zr—3% Hf | Zr—3% Ta | Zr—2% W | Zr—2% Re |
| 6.75 | N/A | Zr—14% Mo | Zr—10% Hf | Zr—8% Ta | Zr—8% W | Zr—7% Re |
| 7 | N/A | N/A | Zr—17% Hf | Zr—14% Ta | Zr—13% W | Zr—12% Re |
| 7.25 | N/A | N/A | N/A | Zr—19% Ta | Zr—18% W | Zr—17% Re |

N/A = Not calculated

In accordance with the Table I above, the mid-density materials may have an alloy selected from the group consisting of: Zr—Nb, Zr—Mo, Zr—Hf, Zr—Ta, Zr—W, and Zr—Re. The densities of the one or more these mid-density materials may range from 6 g/cm$^3$ to 7.25 g/cm$^3$. Zirconium has a density of 6.5 g/cm$^3$ and so adding heavier elements such as niobium, molybdenum, hafnium, tantalum, tungsten, rhenium and so forth will allow us to make materials with density between 6.5 to 7.25 g/cm$^3$. For example, the mid-density material includes Ti—Zr having a density ranging from 4.5 g/cm$^3$ to 6.5 g/cm$^3$ and Ti—Zr—Hf having a density higher than 6.5 g/cm$^3$. The mid-density materials may have two or more elements selected from the group consisting of: Ti, Zr, and Hf to provide a density range from 4.5 g/cm$^3$ to 7.9 g/cm$^3$.

Table I shows possible binary compositions for different heavy element additions. These compositions have been arrived at using the theoretical densities of individual elements, the real density may be slightly less. It should be pointed out that it is not necessary that we consider only binary compositions, a ternary or quaternary alloying additions are also a possibility. For the range of densities between 4.5 and 6.5 g/cm$^3$, it is proposed that we consider a binary titanium-zirconium. There is also the possibility of using hafnium as a heavy metal addition to make alloys having density higher than 6.5 g/cm$^3$. The three metals titanium, zirconium and hafnium are all miscible in each in all proportions so it will be possible to make alloys with higher densities by mixing these three metals in varying proportions.

There are many methods for forming a golf club head using mid-density materials. In one embodiment, the method includes forming a golf club head having a body. At least a portion of the golf club head is formed by introducing at least one or more mid-density materials therein. The mid-density material has a density ranging from 4.5 g/cm$^3$ to 7.9 g/cm$^3$. In one embodiment, at least a portion of the golf club head is made of mid-density materials having a density ranging from 5 g/cm$^3$ to 7.9 g/cm$^3$, and more preferably between approximately 5.5 g/cm$^3$ to 7.5 g/cm$^3$, and even more preferably 6 g/cm$^3$ to 7 g/cm$^3$.

To provide the mid-density materials, in one embodiment, we can use two different paths, i.e. lower the density of iron-based materials from 7.86 g/cm$^3$ to mid-density range (6-7 g/cm$^3$) of density or alternatively we can increase density of titanium alloys from 4.5 g/cm$^3$ to mid-density range (6-7 g/cm$^3$).

In one embodiment, the mid-density materials are provided by decreasing the density of an iron-based material. For example, one or more primary alloying elements are added to the iron-based material. The one or more primary elements are selected from a group consisting of: titanium, vanadium, chromium, manganese, and zirconium. The primary elements have a lower density than iron-based materials and other secondary elements and thereby decrease the density of the iron-based material. In addition, one or more secondary elements are added to the one or more primary elements. The secondary elements are selected from a group consisting of: aluminum, silicon, carbon, and boron. It should be noted that these are merely examples of the types of elements used based upon their relative densities and other properties and that other primary and secondary elements may be used.

In one embodiment, at least one primary element and the iron-based material or primary element and secondary element combined with the iron based material may be co-forged to provide the mid-density material. For example, mid-density materials are alloys such as Fe—Al—Si, Fe—Cr—Al, Fe—Cr—Si, Fe—Ti—Al, Fe—V—Al. The composition of the mid-density material can be expressed in a more general form as Fe—X wt % (Cr, Mn, V, Ti, Zr)—Y wt % (Al, Si, B, C).

The method for co-forging comprising casting the mid-density materials into a preform, homogenizing the preform, annealing the preform, and forging the preform into a golf club head shape with differing cross-sections. In addition, compositions or elements from the list above can be cast as preforms for the forging process. The cast bars could be put through the same metallurgical processes such as homogenizing and annealing as standard steels. Following those processes, the alloy could be forged to the final shape. Forging allows for making shapes with differing cross-sections. Forging would also close the porosity that may be present in the as cast bars.

In another embodiment, the mid-density materials are provided by increasing the density of a titanium alloy material. For example, one or more metallic elements are added to the titanium alloy material. The one or more metallic elements selected from a group consisting of: tungsten, tantalum, zirconium, vanadium, molybdenum, chromium, hafnium, niobium. These metallic elements have a higher density than titanium alloy materials and thereby increase the density of the titanium alloy materials.

In one embodiment, at least one metallic element and the titanium alloy material may be combined to provide the mid-density material. For example, the at least one metallic element and the titanium alloy material are melted and then cast into a golf club head shape made of mid-density material. The binary Ti—Zr, Ti—V, Ti—Cr, Ti—Mo, Ti—Nb, Ti—Hf, Ti—W, Ti—Ta or ternary Ti—W—Ta alloys could be made by melting and casting. For example Ti-32 wt % W alloy will have density of about 6 g/cm$^3$, Ti-40 wt % W will have density of about 6.5 g/cm$^3$, while Ti-46 wt % W will have density of about 7 g/cm$^3$. Generally, these alloys are more geared towards the lower end of the mid-density materials.

In another embodiment, one or more compositions are co-forged in different proportions to provide the mid-density material. Alternatively, the compositions are co-forged and formed into a golf club head with an overall macro density within the range of 4.5 g/cm$^3$ to 7.9 g/cm$^3$. For example, titanium and steel may be co-forged when heated to a temperature of 1000 degrees Celsius.

In one embodiment, the first step in co-forging titanium and steel would be to start with a steel bar. Next, a hole is drilled in the steel bar to accept a titanium rod. The diameter, length and location of this hole is chosen as per the required mass distribution. After the titanium rod is placed inside the hole, the hole is welded shut and any further access of air or oxygen it prevented. This will help protect the interface from oxidation during the forging process. Finally the bi-metal rod is heated to appropriate temperature and forged into the required shape. The amount of titanium required can be analytically determined using the formula VT/VS=(Ds−Df)/(Df−Dt) where VT=Volume of titanium in the bar, VS=Volume of steel in the bar, Ds=Density of steel, Df=Final desired density of the co-forged material, and Dt=Density of the titanium alloy. The method of co-forging also allows for selectively locating the different materials so as to end up with different density materials in different parts of the club head. For example if it is desired that the hosel of the club head be made from steel, then the hole can be located so that there is no titanium in that portion of the bar that gets forged into a hosel.

In further embodiment, one or more compositions are co-forged in different proportions to provide the mid-density material. Here instead of using a single density material such as titanium we can use multiple materials to manipulate the density of the "filler" material. For example if we desire that the filler material density be higher than titanium then we could use titanium and copper or nickel to fill the hole. It should be pointed out that the discussion is not limited to just metallic materials, but ceramic powder compacts could also be used to arrive at the desired final density as desired.

In a further embodiment, another method for manufacturing a golf club head using mid-density materials is provided. One or more rods are provided which are made of one or more compositions or a composite of one or more compositions. The rods are collected together using a collecting structure made of one or more compositions or a composite of one or more compositions. The one or more rods and collecting structure are heated to a forging temperature to provide a preform. The preform is then forged into a golf club head. At least a portion of the golf club head is thereby made of mid-density materials having a density ranging from 4.5 g/cm$^3$ to 7.9 g/cm$^3$.

For example, a 'stranded cable' of metal rods using a blend of different metals may be used to vary the composite density to provide a mid-density material. As discussed above, a blend of titanium and steel bars could be co-forged, yielding a net density between 4.5 g/cm$^3$ and 7.9 g/cm$^3$ more preferably a density ranging from 5 g/cm$^3$ to 7.9 g/cm$^3$, and more preferably between approximately 5.5 g/cm$^3$ to 7.5 g/cm$^3$, and even more preferably 6 g/cm$^3$ to 7 g/cm$^3$. If necessary, other materials could be added if needed for alloying and/or other metallurgical or post-forging needs such as finishing, bendability, etc. This method could either be accomplished by inserting a number of small metal rods of varying materials (as needed to achieve target density) into a thin-walled steel tube, then heating to forging temperature and finally actually forging the heated preform to the final club head shape. Alternatively, the group of rods could be banded together with steel or titanium bands prior to heating and forging. This alternative method could yield unique finishing options as the different metals would probably form novel patterns.

In another embodiment, the mid-density materials may comprise Fe—Al alloys having reduced grain size to increase ductility. Fe—Al alloys may also be used as mid-density materials with reduced or small grain size to increase bendability. For example, the Fe—Al alloys with reduced grain size can be bent 4 degrees or more in the hosel are. This increase in bendability or ductility is attributed to reduced grain size since regular Fe—Al alloys with large grain size produced during processing has more limited ductility.

The grain refinement is achieved by forming dispersoids or other phases at the grain boundaries. Forging is the preferred process for making iron heads using this Fe—Al alloy. Grain growth, i.e. increasing of grain size, occurs when this alloy is heated to elevated temperature during forging. Thus it is necessary to prevent grain growth and this can be achieved by forming dispersoids or other phases which pin the grain boundaries. Once the grain boundaries are pinned, grain growth is severely retarded as boundaries are unable to move.

The formation of dispersoids can be achieved through small additions of elements such titanium and zirconium. These elements are very reactive and especially like to combine with aluminum to form compounds called aluminides. The dispersoids prefer to form on grain boundaries as these are high energy locations in the metallic structure. Once formed, it is expected that the grain boundaries would be pinned and limit or prevent grain growth. It should be noted that these elements need not be added in large quantity as it is not necessary to overwhelm the microstructure with dispersoids. Large number of dispersoids may cause loss of ductility as they become locations of stress concentrations.

The dispersoids can be formed at any stage of processing i.e. they can be formed during casting or during other steps of processing. It is preferred the dispersoids be formed not during casting but be formed during other deformation steps such as rolling or forging. Dispersoids formed during the deformation step are smaller in size and distributed homogenously throughout the microstructure of the metal both of which help maintain ductility. As a grain refiners or dispersoid forming elements, it is suggested that titanium and zirconium be added in quantities no more than 1 wt %.

It is contemplated that titanium and zirconium will react with aluminum to form their respective aluminides and act as dispersoids. The invention contemplates modifying the alloy chemistry by adding elements such as titanium and zirconium. The elements can be added as elements or as aluminum master alloys. Taking the specific case of titanium, titanium as a solid solubility of about 10 wt % in iron. Therefore it is anticipated that titanium will remain in solid solution after the alloy is cast. However titanium also has a strong affinity for aluminum and with aluminum being present in the alloy, the formation of titanium aluminide after casting cannot be ruled out. In any event, once the titanium aluminide is formed it is anticipated that it will act as a dispersoid. Zirconium has much less solid solubility in iron and therefore one would expect that the zirconium aluminide would form during the casting step itself. The invention should not be limited to additions of titanium or zirconium to the Fe—Al alloys. Other elements which are known to refine grain size in steels should also be considered for grain refining Fe—Al alloys.

In summary, a golf club head has at least one or more portions including at least one mid-density material having a density ranging from 4.5 g/cm$^3$ to 7.9 g/cm$^3$ which provide sufficient stiffness at a reduced weight to optimize the center of gravity and moment of inertia of the golf club head. Also, by using mid-density materials, discretionary weight of the golf club head is increase which can be used to position higher density weights at selective portions of the golf club head.

While there is shown and described herein certain specific structure of the exemplary embodiments, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf article of manufacture, comprising:

a golf club head, the golf club head having a body, at least one or more portions of the body made out of a composite of mid-density materials; and the composite of mid-density materials having a density within a range from 4.5 g/cm$^3$ to 7.9 g/cm$^3$, whereby the composite of mid-density materials provides sufficient stiffness at a reduced weight to optimize the center of gravity and moment of inertia of the golf club head, wherein the mid-density materials are co-forged using titanium and steel.

2. The golf article of claim 1, wherein the golf club head includes a body comprising: a crown portion, a sole portion, a toe portion, a heel portion, a hosel portion, a rear portion, and a front portion including a striking face.

3. The golf article of claim 1, wherein the densities of the one or more mid-density materials range from 5 g/cm$^3$ to 7.9 g/cm$^3$.

4. The golf article of claim 1, wherein the densities of the one or more mid-density materials range from 5.5 g/cm$^3$ to 7.5 g/cm$^3$.

5. The golf article of claim a, wherein the densities of the one or more mid-density materials range from 6 g/cm$^3$ to 7 g/cm$^3$.

6. The golf article of claim 1, wherein co-forged steel and titanium is combined with a third element or composition.

7. The golf article of claim 6, wherein the third element is selected from a group consisting of nickel, copper, metallic metals, and ceramic powder compacts.

8. The golf article of claim 1, wherein the steel is in the form of a steel structure and the titanium is in the form of one or more titanium rods which are collected within the steel structure and then co-forged.

9. The golf article of claim 1, wherein the titanium is in the form of a titanium structure and the steel is in the form of one or more steel rods which are collected within the titanium structure and then co-forged.

10. The golf article of claim 1, wherein the mid-density materials have one or more elements selected from the group consisting of: Zr, and Hf.

11. A golf article of manufacture, comprising:

a golf club head, the golf club head having a body, at least one or more portions of the body made out of a composite of mid-density materials; and the composite of mid-density materials having a density within a range from 4.5 g/cm$^3$ to 7.9 g/cm$^3$, whereby the composite of mid-density materials provides sufficient stiffness at a reduced weight to optimize the center of gravity and moment of inertia of the golf club head, wherein the mid-density materials have an alloy selected from the group consisting of, Zr—Nb, Zr—Mo, Zr—Hf, Zr—Ta, Zr—W, and Zr—Re.

12. The golf article of claim 11, wherein the golf club head includes a body comprising: a crown portion, a sole portion, a toe portion, a heel portion, a hosel portion, a rear portion, and a front portion including a striking face.

13. A golf article of manufacture, comprising:

a golf club head, the golf club head having a body, at least one or more portions of the body made out of a composite of mid-density materials; and the composite of mid-density materials having a density within a range from 4.5 g/cm$^3$ to 7.9 g/cm$^3$, whereby the composite of mid-density materials provides sufficient stiffness at a reduced weight to optimize the center of gravity and moment of inertia of the golf club head, wherein the mid-density materials are Fe—Al alloys having reduced gain size.

14. The golf article of claim 13, wherein the Fe—Al alloys having reduced grain size include one or more elements selected from the group consisting of Ti and Zr.

15. The golf article of claim 13, wherein the golf club head includes a body comprising: a crown portion, a sole portion, a toe portion, a heel portion, a hosel portion, a rear portion, and a front portion including a striking face.

* * * * *